US006761138B2

(12) United States Patent
Takahashi et al.

(10) Patent No.: US 6,761,138 B2
(45) Date of Patent: Jul. 13, 2004

(54) VALVE TIMING CONTROL APPARATUS FOR INTERNAL COMBUSTION ENGINE

(75) Inventors: Tatsuhiko Takahashi, Hyogo (JP); Koji Wada, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/281,327

(22) Filed: Oct. 28, 2002

(65) Prior Publication Data

US 2003/0200944 A1 Oct. 30, 2003

(30) Foreign Application Priority Data

Apr. 24, 2002 (JP) ..... 2002-122030

(51) Int. Cl.[7] ..... F01L 1/34

(52) U.S. Cl. ..... 123/90.15; 123/90.16; 123/90.17

(58) Field of Search ..... 123/90.15, 90.16, 123/90.17, 90.27, 90.31

(56) References Cited

U.S. PATENT DOCUMENTS 6,006,708 A * 12/1999 Ken et al. ..... 123/90.17
6,330,870 B1 * 12/2001 Inoue et al. ..... 123/90.17
6,494,173 B2 * 12/2002 Takahashi et al. ..... 123/90.15
6,505,586 B1 * 1/2003 Sato et al. ..... 123/90.17

FOREIGN PATENT DOCUMENTS

JP 2002-256826 9/2002

OTHER PUBLICATIONS

Wada et al., Valve Timing Control Apparatus for Internal combustion Engine, US Patent Application Publication, US 2003/0196622 A1, Oct. 23, 2003.*

* cited by examiner

*Primary Examiner*—Thomas Denion
*Assistant Examiner*—Ching Chang
(74) *Attorney, Agent, or Firm*—Sughrue Mion, PLLC

(57) ABSTRACT

Valve timing control apparatus for internal combustion engine includes a cam phase actuator (1113) composed of a first rotor (1) rotatable with a crank, a second rotor (6) fixed on a cam shaft (7) for actuating an intake or exhaust valve, and a lock mechanism (15, 16, 17, 18) for locking the second rotor to the first rotor at a first angle, a pump (1118) for generating a hydraulic pressure, an ECU (1117) for determining a current value for releasing a locked state at the first angle for shifting to a second angle, and an oil control valve (1114) for regulating a cam phase of the second rotor. The ECU determines a locked state or an unlocked state of the lock mechanism to allow the second rotor to be released from being locked to the first rotor when the lock mechanism is in the locked state.

10 Claims, 12 Drawing Sheets

VALVE TIMING CONTROL APPARATUS FOR INTERNAL COMBUSTION ENGINE

BACKGROUND OF THE INVENTION

1. Field of the Invention

The present invention relates generally to a valve timing control apparatus for controlling valve open/close timing (hereinafter referred to simply as the valve timing) at which an intake valve or an exhaust valve of an internal combustion engine is opened or closed in dependence on operating state or condition of the engine.

2. Description of Related Art

In the field of the internal combustion engines, there have been proposed various apparatuses which make it possible to controllably change the valve timing for the intake valve or the exhaust valve of the internal combustion engine (hereinafter also referred to simply as the engine). For better understanding of the present invention, background techniques thereof will first be described in some detail by reference to FIG. 8 of the accompanying drawings which shows generally and schematically a structure of an internal combustion engine equipped with a conventional valve control apparatus.

Referring to FIG. 8, reference numeral 1101 denotes an internal combustion engine which includes an intake pipe 1104 equipped with an air cleaner 1102 for purifying the air sucked into the engine 1101, an air-flow sensor 1103 for measuring the intake air quantity (flow rate of the intake air), a throttle valve 1105 for regulating the intake air quantity to control the output torque of the engine 1101 and a fuel injector 1106 for injecting an amount of fuel compatible with the intake air quantity.

Further, the engine 1101 is provided with a spark plug 1111 for generating sparks for firing the air-fuel mixture charged in a combustion chamber of the engine 1101, an ignition coil 1110 for supplying a high-voltage energy to the spark plug 1111, an exhaust pipe 1107 for discharging an exhaust gas resulting from combustion of the air-fuel mixture, an $O_2$-sensor 1108 disposed in the exhaust pipe 1107 for detecting a residual amount of oxygen contained in the exhaust gas, and a three way catalytic converter 1109 capable of purifying concurrently harmful gas components contained in the exhaust gas such as THC, CO and $NO_x$.

A sensor plate 1116 having a tooth or projection (not shown) formed at a predetermined position is mounted on a crank shaft (not shown either) corotatably therewith for detecting the crank angle (angular position of the crank shaft) in cooperation with a crank angle sensor 1115 which is so designed as to generate a signal upon every passing-by of the projection (not shown) of the sensor plate 1116 for detecting the crank angle (angular position of the crank shaft).

Further provided are a cam phase actuator 1113 for changing a relative angle of a cam shaft relative to the crank shaft and a cam angle sensor 1112 for generating a pulse signal upon passing-by of a projection of a cam angle detecting sensor plate (not shown) to thereby detect the cam angle in a similar manner as the crank angle sensor 14 described above.

Provided in association with the cam phase actuator 1113 are an oil control valve (hydraulic pressure regulating means) 1114 for regulating hydraulic pressure applied to the cam phase actuator 1113 to thereby control the relative angle (cam phase) of the cam shaft relative to the crank shaft and an ECU (electronic control unit serving as arithmetic means as well) 1117 which is in charge of controlling the cam phase in addition to an overall control of operation of the internal combustion engine 1101.

Further provided are an oil pump 1118 for generating a hydraulic pressure to drive the cam phase actuator 1113 while feeding a lubricating oil under pressure to mechanical constituent parts of the internal combustion engine 1101 and a hydraulic pressure sensor 1119 for detecting the hydraulic pressure of the lubricating oil fed under pressure to the oil control valve 1114 from the oil pump 1118.

Additionally, the engine is provided with an oil temperature sensor 1120 for detecting temperature of the oil fed under pressure from the oil pump 1118 to the oil control valve 1114 and a water temperature sensor 1122 for detecting temperature of cooling water 1121 employed for cooling the engine 1101.

As a typical one of the hitherto known valve timing control apparatus (cam phase actuator) 1113 for the engine 1101, there can be mentioned the apparatus shown in FIGS. 9 to 13 of the accompanying drawings, in which FIG. 9 is a view showing an internal structure of a conventional vane-type valve timing control apparatus, and FIG. 10 is a vertical sectional view of the same taken along a line A—A shown in FIG. 9.

Further, FIG. 11 is an enlarged perspective view showing a major portion of a lock/unlock mechanism of the conventional vane-type valve timing control apparatus and FIGS. 12 and 13 are vertical sectional views showing the lock/unlock mechanism, respectively.

Next, referring to FIGS. 9 to 13, description will be made of the conventional valve timing control apparatus 1113.

Referring to the figures, the cam phase actuator (valve timing control apparatus) 1113 includes a first rotor assembly (also referred to as the first rotor) 1 (FIG. 10) which is operatively coupled to the crank shaft (not shown) serving as the output shaft of the engine so that the first rotor assembly 1 rotates in synchronism with the crank shaft.

The first rotor assembly 1 is comprised of a sprocket 2 adapted to rotate together with the crank shaft, a case 3 having a plurality of projecting shoes 3*a* (FIG. 9) which project radially inwardly from the inner peripheral portion of the case 3 to thereby define a corresponding number of hydraulic chambers, and a cover 4 (FIG. 10) for fluid-tightly closing the hydraulic chambers constituted by the projecting shoes 3*a* of the case 3, wherein the sprocket 2, the case 3 and the cover 4 are secured together by means of clamping members 5 such as bolts or the like (FIGS. 9, 10) in an integral structure.

Disposed within the case 3 rotatably relative to the first rotor assembly 1 is a rotor (second rotor) 6 (FIG. 9) which is integrally secured to the cam shaft 7 by means of a clamping member 8 such as a bolt or the like (FIG. 10). The cam shaft 7 constitutes a part of the mechanism for opening/closing the intake valve or the exhaust valve. The second rotor 6 includes a plurality of vanes 6*a* (FIGS. 9 and 11) each of which serves to partition each of the hydraulic chambers defined by the projecting shoes 3*a*, respectively, into a valve timing advancing hydraulic chamber 9 and a valve timing retarding hydraulic chamber 10 (FIG. 9).

Further formed internally of the cam shaft 7 are first oil passages (hydraulic chamber feed passages) 11 through which hydraulic pressure is fed/discharged to/from the valve timing advancing hydraulic chambers 9, respectively, and second oil passages (pressure chamber feed passages) 12 through which the hydraulic pressure is fed/ discharged to/from the valve timing retarding hydraulic chambers 10, respectively. See FIG. 10.

Disposed at a tip end portion of each of the projecting shoes 3*a* of the case 3 and a tip end portion of each of the vanes 6*a* of the second rotor 6, respectively, are oil sealing means 13 for preventing occurrence of oil leakage between the valve timing advancing hydraulic chamber 9 and the valve timing retarding hydraulic chamber 10 (FIGS. 9 and 10).

Formed in one of the vanes 6*a* of the second rotor 6 is a receiving hole 14 (FIG. 10) for receiving therein a lock pin. More specifically, a lock pin 15 (which may also be referred to as locking member or locking mechanism) which is implemented as a straight pin of a substantially cylindrical shape is disposed within the receiving hole 14 for the purpose of restricting relative rotation between the first rotor assembly 1 and the second rotor 6 (FIG. 10).

In the engine starting phase or state in which no hydraulic pressure is effective internally of the cam phase actuator, the lock pin 15 serves to prevent the second rotor 6 from vibrating in the rotating direction under a reaction force of a cam (not shown) integrally secured to the cam shaft 7 to thereby suppress knocking noise which will otherwise be generated through repetitive impacts of the second rotor 6 on the first rotor assembly 1.

To this end, the lock pin 15 is constantly resiliently urged toward the first rotor assembly 1 under the influence of urging means (constituting a part of locking means) 16 such as a coil spring disposed between the rear wall of the receiving hole 14 and the lock pin 15 so that the lock pin 15 can engage in a retaining hole which will be described hereinafter (FIG. 10).

Further, a discharging hole (constituting a part of unlock mechanism) 17 is formed in communication with the receiving hole 14 for discharging the back pressure acting on the lock pin 15 (FIG. 10).

On the other hand, the sprocket 2 which constitutes a part of the first rotor assembly 1 is provided with a retaining hole (lock mechanism) 18 at a position where the lock pin 15 can be received in the retaining hole 18 when the second rotor 6 assumes a most retard position relative to the first rotor assembly 1.

A pin releasing or unlocking hydraulic chamber 18*a* is defined between the inner wall of the retaining hole 18 and an outer wall of the lock pin 15 (FIGS. 12, 13).

The vane 6*a* having the receiving hole 14 formed therein is provided with a check valve (unlock mechanism) 19 for releasing the lock pin 15 from the state retained or locked in the retaining hole 18 by selecting either the valve timing advancing hydraulic chamber 9 or the valve timing retarding hydraulic chamber 10 in which higher pressure prevails, to thereby allow the pressure within the selected chamber to be fed into the retaining hole 18 in which the lock pin 15 is retained or locked (FIGS. 11, 12 and 13).

The check valve 19 is hydraulically communicated to the interior of the retaining hole 18 by way of a first pin unlocking hydraulic pressure feed passage (constituting a part of unlock mechanism) 20 formed in the vane 6*a* of the second rotor 6 and a second pin unlocking hydraulic pressure feed passage (constituting a part of unlock mechanism) 21 formed in the sprocket 2 (FIGS. 12 and 13).

Further, the check valve 19 and the valve timing advancing hydraulic chamber 9 are communicated with each other by way of a valve timing advancing hydraulic pressure distribution passage (unlock mechanism) 22 (FIGS. 11, 12 and 13). Similarly, the check valve 19 and the valve timing retarding hydraulic chamber 10 are communicated with each other by way of a valve timing retarding hydraulic pressure distribution passage (unlock mechanism) 23 (FIGS. 11, 12 and 13).

Furthermore, the valve timing retarding hydraulic chamber 10 is communicated with a back pressure chamber 14*a* of the receiving hole 14 by way of a purge passage 24 (FIGS. 11, 12 and 13).

Now, description will turn to operation of the conventional valve timing control apparatus of the structure described above.

The ECU 1117 is so designed or programmed as to arithmetically determine or compute a target or desired phase angle on the basis of the operating state of the engine 1101. Further, the ECU 1117 arithmetically determines a detected phase angle indicative of the valve timing on the basis of the crank angle detected by the crank angle sensor 1115 and the cam angle detected by the cam angle sensor 1112, to thereby arithmetically determine deviation of the detected phase angle from the desired phase angle (i.e., difference or error between the desired phase angle and the detected phase angle).

Further, the ECU 1117 arithmetically determines or computes an energizing current value (conduction current value) or duty ratio for the oil control valve 1114 on the basis of the error between the detected phase angle and the desired phase angle so that the former coincides with the latter.

The oil control valve 1114 selects the oil passage for the cam phase actuator 1113 on the basis of the computed value to thereby control the valve timing by adjusting the hydraulic pressure.

In the starting operation of the engine 1101, the oil control valve 1114 is so controlled that the hydraulic medium or oil is supplied or fed to the valve timing retarding hydraulic chambers 10 of the cam phase actuator 1113.

On the other hand, when the operation of the engine 1101 is stopped, there is the possibility that the oil within the cam phase actuator 1113 and the oil passage extending from the oil pump 1118 to the cam phase actuator 1113 may be discharged into an oil pan. In that case, when the engine operation is started, the air or the air containing oil within the oil passage is introduced into the valve timing retarding hydraulic chambers 10 to be discharged exteriorly from the cam phase actuator by way of the purge passage 24, the back pressure chamber 14*a* and the discharging hole 17.

Once the operation of the engine 1101 has been started, the hydraulic pressure is also introduced into the pin unlocking hydraulic chamber 18*a* from the valve timing retarding hydraulic pressure distribution passage 23. However, the lock pin 15 is held in the state retained within the retaining hole 18 under the biasing force of the urging means 16. In this manner, generation of abnormal noise due to rattling of the second rotor 6 with the lock pin 15 being released from the retaining hole 18 in the engine starting phase can positively be suppressed or prevented.

In the engine starting operation, in the course of the hydraulic pressure being fed to the valve timing retarding hydraulic chamber 10 from the oil pump 1118, the air trapped within the valve timing retarding hydraulic chamber 10 is exhausted from the apparatus via the purge passage 24 and the discharging hole 17. When the air has been discharged, the residual hydraulic pressure becomes effective due to the oil supplied to the back pressure chamber 14*a* to thereby prevent the unlocking by increasing the hydraulic pressure at which the lock pin is released.

When the driver of the motor vehicle equipped with the engine system now under consideration depresses an accelerator pedal in succession to the starting of the engine operation to thereby issue a valve timing advancing command, the ECU 1117 responds thereto by controlling the oil control valve 1114 such that the hydraulic pressure is introduced into the valve timing advancing hydraulic chambers 9.

Then, the oil within the valve timing advancing hydraulic chamber 9 is introduced into the pin unlocking hydraulic chamber 18*a* by way of the valve timing advancing hydraulic pressure distribution passage 22, as a result of which the hydraulic pressure of the oil introduced into the pin unlocking hydraulic chamber 18*a* acts on the tip end of the lock pin 15 to push it in the releasing or unlocking direction against only the biasing force of the urging means 16.

Since the oil control valve 1114 is controllably set to the position where the oil is discharged from the valve timing retarding hydraulic chambers 10, the oil contained within the valve timing retarding hydraulic chambers 10 is discharged into the oil pan by way of the oil control valve 1114.

Consequently, the lock pin 15 is pushed outwardly from the retaining hole 18 to be released from the locked state. Now, the second rotor 6 is in the state to operate. More specifically, the second rotor 6 is rotated in the valve timing advancing direction under the hydraulic pressure within the valve timing advancing hydraulic chambers 9, whereby the valve timing advancing control is performed.

The conventional valve timing control apparatus for the internal combustion engine described above however suffers from a problem that when the desired phase angle changes rapidly from the position at which the lock pin 15 is retained in the retaining hole 18 due to rapid change of the engine operating state which occurs immediately after the engine 1101 has been started, lowering of the hydraulic pressure brought about by abnormal lowering of the rotation speed or for other reasons, operation of the second rotor 6 is activated earlier before the lock pin 15 has been disengaged from the retaining hole 18, as a result of which the lock pin 15 is twisted or sticked or tangled without being withdrawn from the retaining hole 18, making it impossible for the second rotor 6 to operate in the desired direction.

When the valve timing can not be controlled to the desired phase angle due to the twisting or tangling of the lock pin 15, degradation will naturally occur in respect to the drivability, fuel cost performance and the exhaust gas quality, presenting another problem.

SUMMARY OF THE INVENTION

In the light of the state of the art described above, it is an object of the present invention to provide a valve timing control apparatus for an internal combustion engine in which the problem of the valve timing advancing control failure due to entanglement or sticking (jam in more general term) of the lock pin can successfully and satisfactorily be solved and thus the drivability, fuel cost performance and the exhaust gas quality of the engine can significantly be improved.

In view of the above and other objects which will become apparent as the description proceeds, the present invention is directed to a valve timing control apparatus for an internal combustion engine, which apparatus includes a cam phase actuator composed of a first rotor rotatable in synchronism with a crank shaft, a second rotor fixed on a cam shaft for opening and closing an intake valve or alternatively an exhaust valve and a lock mechanism for locking the second rotor to the first rotor at a first relative angle.

The valve timing control apparatus further includes oil pump for generating a hydraulic pressure, an arithmetic unit for arithmetically determining a current value for releasing the locked state at the first relative angle to thereby shift the first relative angle to a second relative angle, and a hydraulic pressure regulating unit for supplying a hydraulic pressure for regulating a cam phase of the second rotor.

In the valve timing control apparatus mentioned above, the arithmetic unit is so designed as to determine discriminatively the locked state and an unlocked state of the lock mechanism to thereby allow the second rotor to be released from the state locked to the first rotor when the lock mechanism is determined as being in the locked state.

By virtue of the arrangement of the valve timing control apparatus described above, the unlocking control is effectuated only when the valve timing advancing control is to be performed in response to the decision that the lock pin is in the locked state, Thus, the frequency of occurrence of delay in the valve timing advancing operation due to failure of timely unlocking control can be reduced, whereby drivability, fuel cost performance and exhaust gas quality of the internal combustion engine can be protected against degradation with enhanced reliability.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
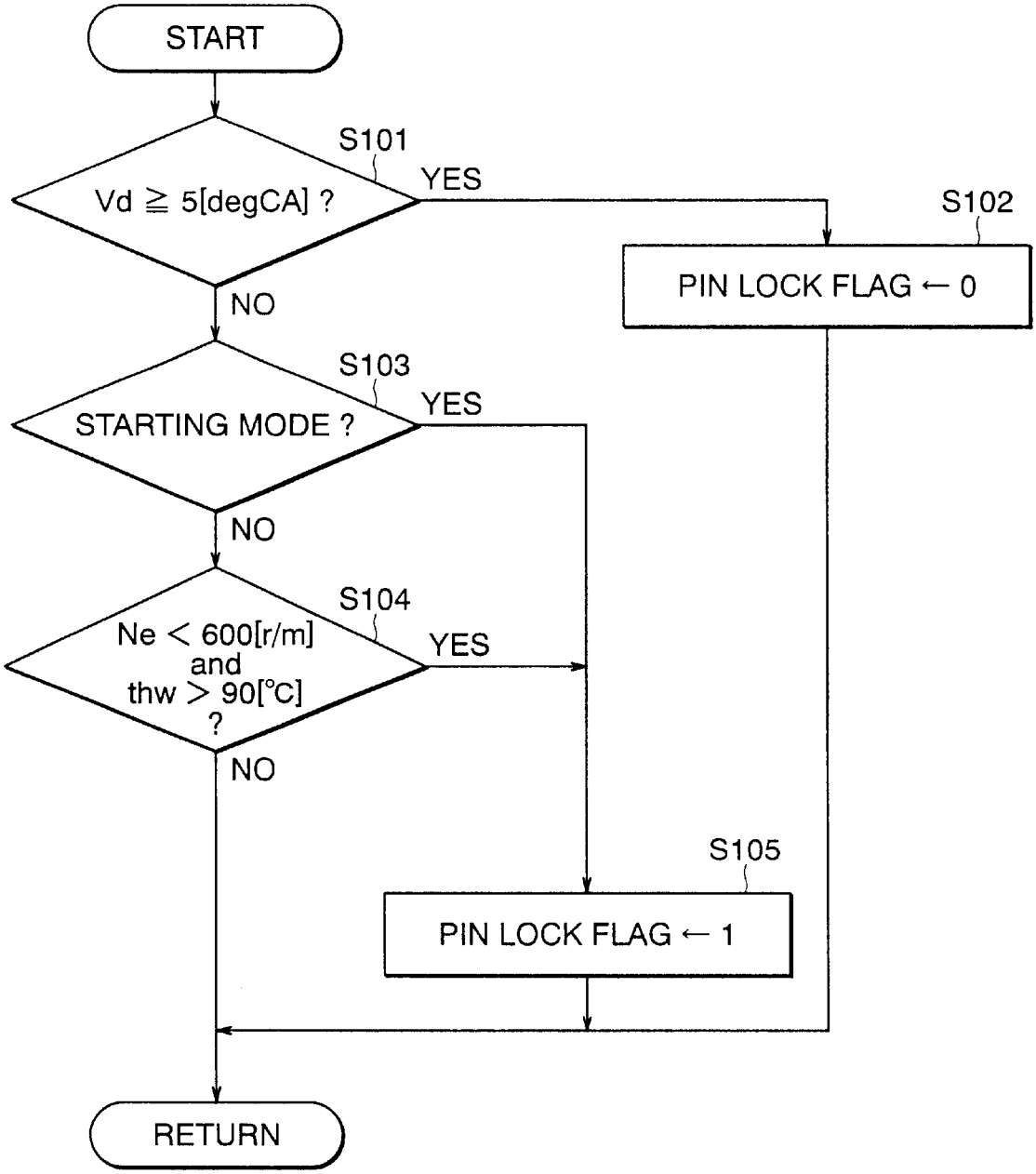
FIG. 1 is a flow charts for illustrating a processing routine executed by an ECU in a valve timing control apparatus according to a first embodiment of the present invention.

The present invention will be described in detail in conjunction with what is presently considered as preferred or typical embodiments thereof by reference to the drawings. In the following description, like reference characters designate like or corresponding items throughout the several views.

Embodiment 1

Now, the valve timing control apparatus according to a first embodiment of the present invention will be described in detail by reference to the drawings. Incidentally, the mechanical structure of the valve timing control apparatus according to the instant embodiment of the invention is essentially same as that of the conventional apparatus described hereinbefore in conjunction with FIGS. 8 to 13. The valve timing control apparatus now under consideration differs from the conventional one only in several operations or processings executed by the ECU 1117. Accordingly, the following description will primarily be directed to the operations which differ from those of the conventional apparatus. With regard to the other respects, repeated description will be omitted.

Figure 2:
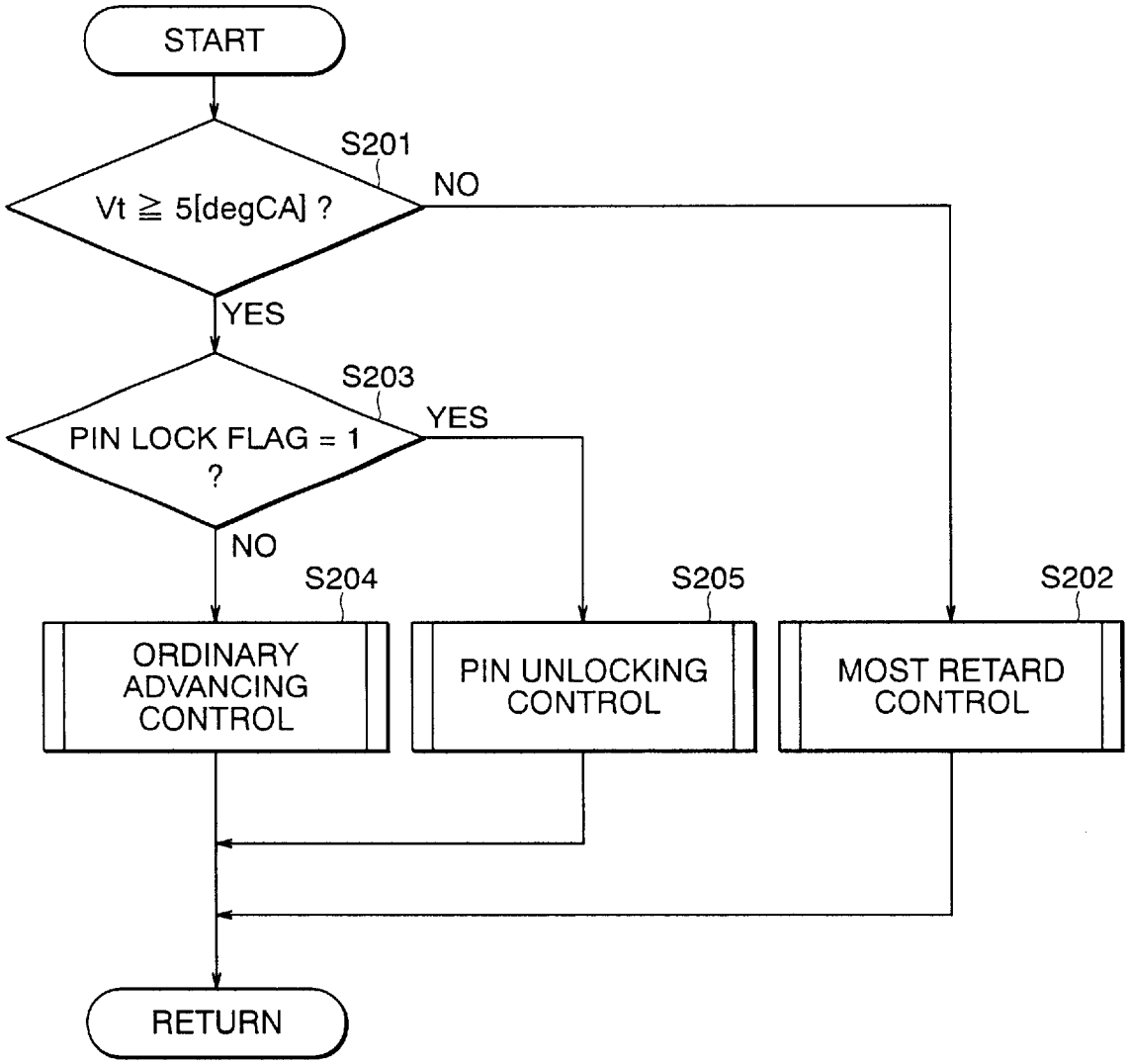
FIG. 2 is a flow chart for illustrating a processing routine executed by the ECU in the valve timing control apparatuses according to the first to fourth embodiments, respectively, of the present invention.

Referring to FIGS. 1 and 2, description will be made of a locked state decision operation performed by the ECU 1117. FIGS. 1 and 2 are flow charts for illustrating processing routines executed by the ECU (Electronic Control Unit) of the valve timing control apparatus according to a first embodiment of the present invention.

When a desired or target phase angle Vt is arithmetically determined for the phase feedback control, the processing routines shown in FIGS. 1 and 2, respectively, are executed in this order.

Now referring to FIG. 1, decision is made in a step S101 whether or not a detected phase angle Vd is equal to or greater than a predetermined value (e.g. 5 [deg. CA]).

When it is determined in the step S101 that the detected phase angle Vd is greater than the predetermined value (e.g. 5 [deg CA]) inclusive (i.e., when the decision step S101 results in affirmation "YES"), this means that the rotor 6 is in the position capable of operating in the valve timing advancing direction with the lock pin 15 having been retracted from the retaining hole 18, i.e., in the unlocked state. Accordingly, a pin-lock flag is set to "0" in a step S102, whereupon the processing routine shown in FIG. 1 comes to an end [Return].

On the other hand, when it is determined in the step S101 that the detected phase angle Vd is smaller than the predetermined value (e.g. 5 [deg CA]) (i.e., when the decision step S101 results in negation "NO"), this means that the rotor 6 is not operative in the valve timing advancing direction and that the lock pin 15 has not been released from the retaining hole 18. In this case, a step S103 is executed to decide whether or not the internal combustion engine 1101 is in a starting state with a starter (not shown) being operated (starting mode).

When it is decided in the step S103 that the engine 1101 is in the starting mode (i.e., when the decision step S103 results in "YES"), it is then determined that the lock pin 15 is still retained in the retaining hole 18 (i.e., the lock pin 15 is in the locked state) because in the engine starting mode, no hydraulic pressure is generated by the oil pump 1118 for the engine 1101 as in the case of the state in which the engine is stopped. In this case, the lock-pin 15 is retained in the retaining hole 18, i.e., the lock pin 15 is in the locked state. Accordingly, the pin-lock flag is set to "1" in a step S105, whereupon the processing routine shown in FIG. 1 comes to an end [Return].

On the other hand, when it is decided in the step S103 that the engine is not in the starting mode (i.e., when the decision step S103 results in "NO"), the state of the lock pin 15 is decided on the basis of numerical values of the rotation speed (r/m) Ne of the engine 1101 and the cooling water temperature thw (step S104).

When it is determined in the step S104 that the engine rotation speed Ne is smaller than a predetermined value (e.g. 600 [r/m]) and the cooling water temperature is higher than a predetermined value thw (e.g. 90 [° C.]) (i.e., when the decision step S104 results in "YES"), it is then decided in the step S104 that the lock pin 15 is in the locked state, whereupon the pin-lock flag is set to "1" in the step S105 [Return].

When it is decided in the step S104 that both the rotation speed Ne and the cooling water temperature thw do not satisfy the respective conditions (i.e., when the decision step S104 results in "NO"), the processing routine shown in FIG. 1 is terminated straightforwardly.

In this conjunction, it is to be noted that the processing routine is terminated without initializing the value of the pin-lock flag. Accordingly, when the engine 1101 is not in the starting mode and when the rotation speed (r/m) Ne is greater than the predetermined value inclusive with the cooling water temperature thw being lower than the predetermined value inclusive, the control operation illustrated in the flow chart in FIG. 2 is performed on the value set in the past. However, because the pin unlocking control has to be carried out without fail once the engine operation has been started even when the value of the pin-lock flag has been set to "1", the use of the value set in the past involves no problem.

In succession, the processing routine illustrated in FIG. 2 is carried out on the basis of the result of the decision concerning the locked state described above by reference to FIG. 1.

Now referring to FIG. 2, decision is made in a step S201 whether the target phase angle Vt is equal to or greater than a predetermined value (e.g. 5 [deg. CA]).

When it is decided in the step S201 that the target phase angle Vt is smaller than the predetermined value (i.e., when the decision step S201 results in "NO"), the valve timing advancing control is not effectuated but the valve timing control is performed at the most retard position (step S202).

On the other hand, when it is determined in the step S201 that the target phase angle Vt is greater than the predetermined value inclusive (i.e., when the decision step S201 results in "YES"), decision is then made as to whether or not the pin-lock flag value is "1" (step S203).

When it is decided in the step S203 that the pin-lock flag value is not "1" (i.e., when the decision step S203 results in "NO"), it is determined that the lock pin 15 (FIG. 10) is in the unlocked state. In this case, the ordinary valve timing advancing control is performed (step S204). On the contrary, when it is determined that the pin-lock flag is set to "1" (i.e., when the decision step S203 results in affirmation "YES"), this indicates that the lock pin is in the locked state. In this case, a pin unlocking control is performed for unlocking the lock pin 15 in a step S205.

In this conjunction, the pin unlocking control in the step S205 is, for example, so performed that feeding of the hydraulic pressure to the valve timing advancing hydraulic chambers 9 is effected at a low rate with the current supplied to the oil control valve 1114 being increased only progressively in order to ensure that the rotor 6 is put into operation only after the lock pin 15 has been disengaged or released from the retaining hole 18.

In this manner, decision as to the locked state of the lock pin 15 is made on the basis of the detected phase angle indicating the operating state of the valve timing control apparatus and the rotation speed Ne and the cooling water temperature thw indicating the operating state of the internal combustion engine, whereon the control is performed in conformance with the result of decision.

Further, because the pin unlocking control is effectuated only when the advancing control is performed in response to the decision that the pin 15 is in the locked state, the frequency of occurrence of a delay in the valve timing advancing operation due to the pin unlocking control can be reduced.

Besides, by carrying out the pin unlocking control in precedence to the valve timing advancing control in response to the decision that the pin 15 is in the locked state, the valve timing advancing control can be carried out smoothly without incurring jam (e.g. twist, stick, tangling, etc.) of the lock pin 15. Thus, the drivability, fuel cost performance and the exhaust gas quality of the internal combustion engine can positively be protected against degradation.

Embodiment 2

In the valve timing control apparatus according to the first embodiment of the invention, the locked state of the lock pin 15 is determined on the basis of the detected phase angle Vd, the engine rotation speed (r/m) Ne and the cooling water temperature thw. In the valve timing control apparatus according to a second embodiment of the invention, the detected phase angle Vd and the hydraulic pressure Po of the engine 1101 are used for making decision as to whether the lock pin is locked or not.

The mechanical structure of the valve timing control apparatus according to the second embodiment of the invention is essentially same as that of the conventional apparatus described hereinbefore in conjunction with FIGS. 8 to 13. The apparatus according to the instant embodiment differs from the conventional one only in several operations performed by the ECU 1117. Accordingly, the following description will be directed to the operations or processings which differ from those of the conventional apparatus. With regard to the other respects, repeated description will be omitted. Additionally, the processing procedure shown in FIG. 2 is executed without any modification. Accordingly, repeated description thereof will be unnecessary.

Figure 3:
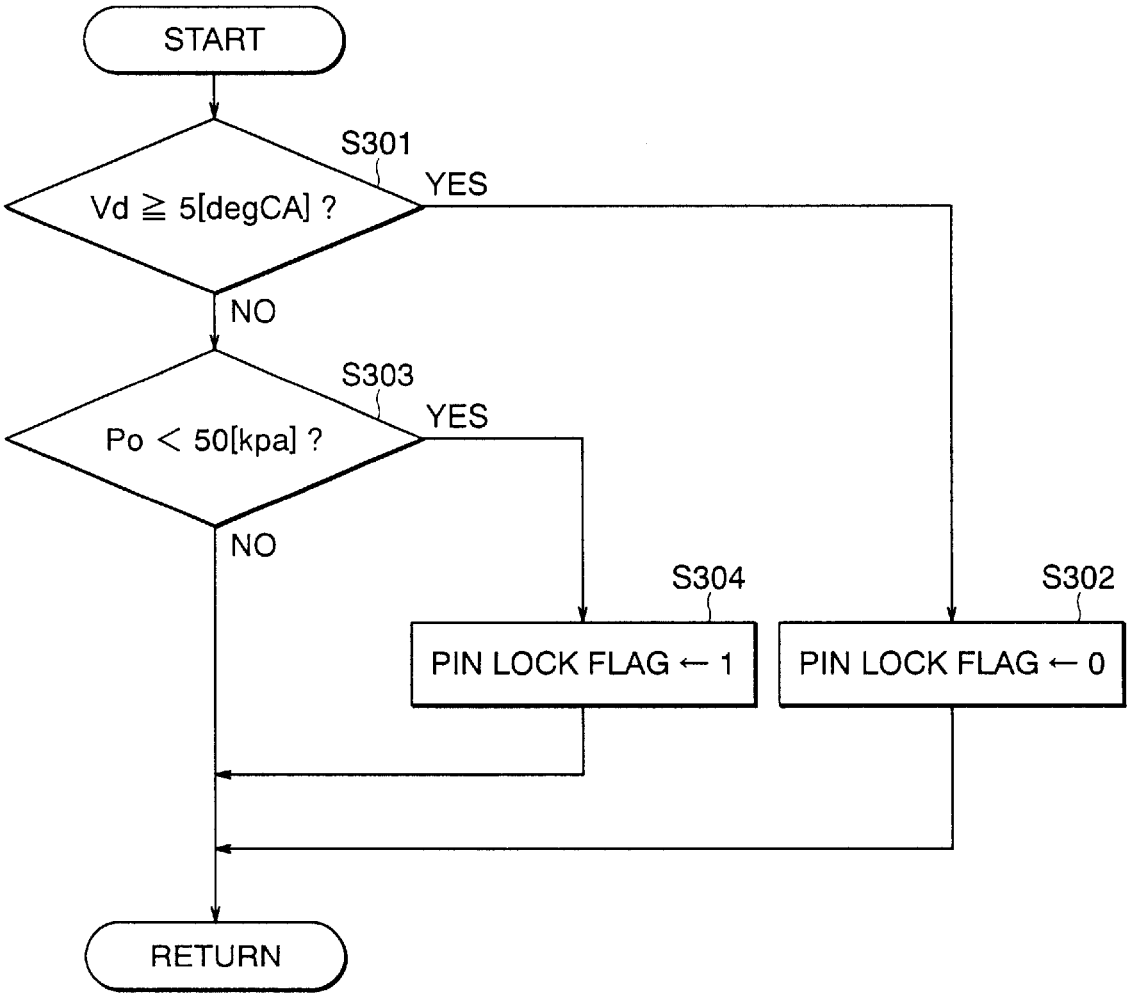
FIG. 3 is a flow chart for illustrating a processing routine executed by the ECU in the valve timing control apparatus according to a second embodiment of the present invention.

Referring to FIG. 3, description will be made of the locked state decision processing executed by the ECU 1117. FIG. 3 is a flow chart for illustrating a processing routine executed by the ECU 1117 of the valve timing control apparatus according to the second embodiment of the present invention.

Now referring to FIG. 3, decision is made in a step S301 whether or not the detected phase angle Vd is equal to or greater than a predetermined value (e.g. 5 [deg. CA]).

When it is determined in the step S301 that the detected phase angle Vd is greater than the predetermined value inclusive (i.e., when the decision step S301 results in "YES"), this indicates that the lock pin 15 is in the unlocked state. Accordingly, the pin-lock flag is set to "0" in a step S302, whereon the processing routine shown in FIG. 3 is terminated [Return].

On the other hand, when it is determined in the step S301 that the detected phase angle Vd is smaller than the predetermined value (i.e., when the decision step S301 results in "NO"), decision is succeedingly made in a step S303 whether or not the hydraulic pressure Po of the engine 1101 is lower than a predetermined value (e.g. 50 [kPa]).

When it is determined in the step S303 that the hydraulic pressure Po is lower than the predetermined value (i.e., when the decision step S303 results in "YES"), it is then determined in the step S303 that the lock pin 15 is in the locked state. Thus, the pin-lock flag is set to "1" in a step S304. Then, the processing routine shown in FIG. 3 comes to an end [Return].

On the other hand, when it is determined in the step S303 that the hydraulic pressure Po is greater than the predetermined value inclusive (i.e., when the decision step S303 results in "NO"), the processing routine shown in FIG. 3 is terminated straightforwardly.

In this conjunction, it is noted that the processing routine is terminated without initializing the value of the pin-lock flag. Accordingly, when the detected phase angle Vd is smaller than the predetermined value and when the hydraulic pressure Po is higher than the predetermined value inclusive, the decision as to the pin unlocking illustrated in the flow chart in FIG. 2 is performed on the value set in the past. However, because the pin unlocking control has to be carried out without fail once the engine operation has been started even when the value of the pin-lock flag is "1", the use of the value set in the past does not involve any especial problem.

For detecting the hydraulic pressure, it is required to dispose the hydraulic pressure sensor (hydraulic pressure detecting means) 1119 in the hydraulic passage extending from the oil pump 1118 to the hydraulic pressure sensor 1119. In this conjunction, it is noted that due to the resistance internally of the hydraulic pipe, the hydraulic pressure prevailing in the vicinity of the inlet port of the inlet port of the oil control valve is lower than that prevailing in the vicinity of the outlet of the oil pump. Such being the circumstance, it is preferred to install the hydraulic pressure sensor 1119 at a location near to the inlet port of the oil control valve in order to detect accurately the hydraulic pressure.

Furthermore, the hydraulic pressure may become lower in the course of flowing through the oil control valve 1114. Accordingly, the hydraulic pressure sensor 1119 should preferably be installed at a position downstream of the oil control valve 1114 in order to detect the hydraulic pressure applied to the lock pin 15 with higher accuracy.

After the decision as to the locked/unlocked state through the routine shown in FIG. 3, the processing procedure shown in FIG. 2 is executed to make decision as to whether or not the pin unlocking control should be performed in association with the valve timing advancing control, and the pin unlocking control is carried out when the pin is in the locked state while the ordinary valve timing advancing control is effected if the pin is in the unlocked state.

As is apparent from the above, it is possible to make decision as to the locked state of the lock pin 15 with high reliability on the basis of the hydraulic pressure detected directly by the hydraulic pressure sensor 1119.

Further, because the pin unlocking control is effectuated only when the advancing control is to be performed in the state where the pin 15 is in the locked state, the frequency of occurrence of a delay in the valve timing advancing operation due to the pin unlocking control can be decreased.

Besides, by carrying out the pin unlocking control in response to the decision that the pin 15 is in the locked state, the lock pin 15 can be prevented from falling into the jammed state. Thus, the drivability, fuel cost performance and the exhaust gas quality of the engine can positively be protected against degradation which may otherwise be brought about by the jam of the lock pin 15.

Embodiment 3

In the valve timing control apparatus according to the second embodiment of the invention, the locked state of the lock pin 15 is determined on the basis of the detected phase angle Vd and the hydraulic pressure Po. In the valve timing control apparatus according to a third embodiment of the invention, only the detected phase angle Vd is used for making decision as to the locked state of the lock pin.

Parenthetically, the structure of the valve timing control apparatus according to the third embodiment of the invention is essentially same as that of the conventional apparatus described hereinbefore in conjunction with FIGS. 8 to 13. The apparatus according to the instant embodiment differs from the conventional one only in several operations performed by the ECU 1117. Accordingly, the following description will be directed to the operations or processings which differ from those of the conventional apparatus. With regard to the other respects, repeated description will be omitted. Additionally, the processing procedure shown in FIG. 2 is executed without any modification. Accordingly, repeated description thereof will be unnecessary as well.

Figure 4:
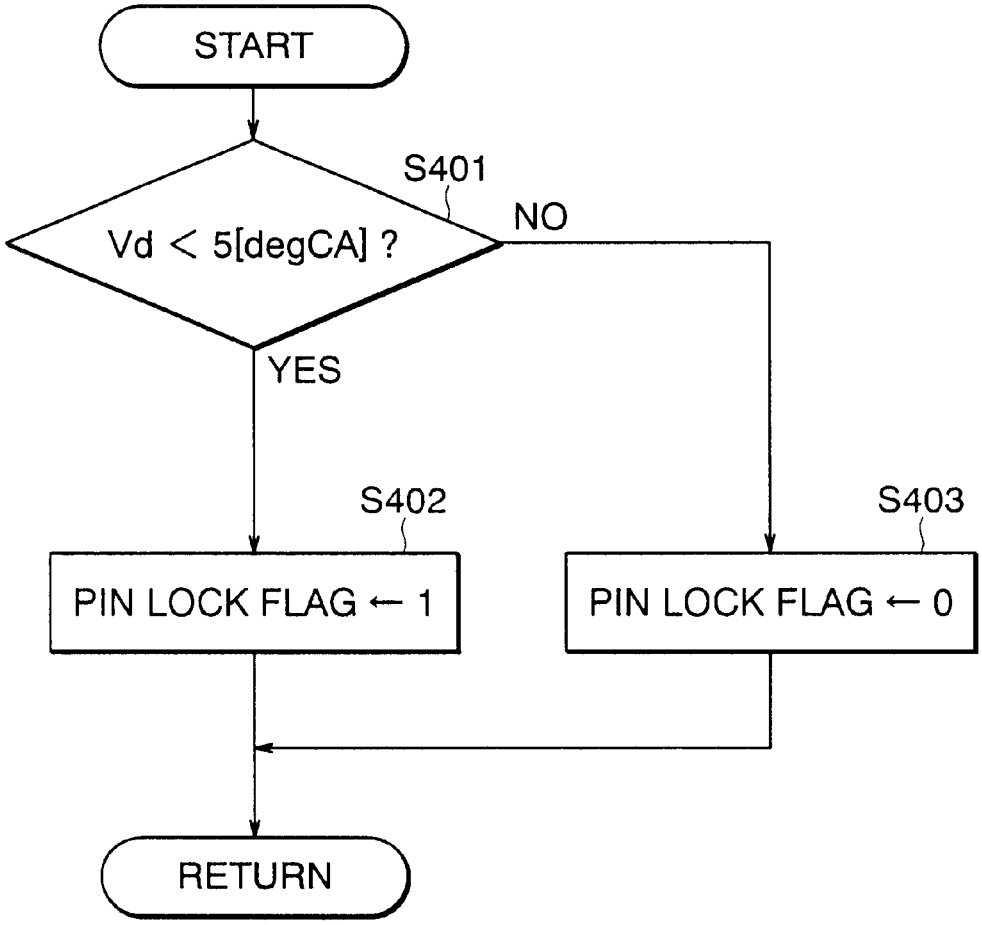
FIG. 4 is a flow chart for illustrating a processing routine executed by the ECU in the valve timing control apparatus according to a third embodiment of the present invention.

Referring to FIG. 4, description will be made of the locked state decision processing executed by the ECU 1117. FIG. 4 is a flow chart for illustrating a processing routine executed by the ECU in the valve timing control apparatus according to the third embodiment of the present invention.

Now referring to FIG. 4, decision is made in a step S401 whether or not the detected phase angle Vd is smaller than a predetermined value (e.g. 5 [deg. CA]).

When it is determined in the step S401 that the detected phase angle Vd is smaller than the predetermined value (i.e., when the decision step S401 results in "YES"), this indicates that the lock pin 15 is in the locked state. Accordingly, the pin-lock flag is set to "1" in a step S402, whereon the processing routine shown in FIG. 4 comes to an end [Return].

By contrast, when it is determined in the step S401 that the detected phase angle Vd is greater than the predetermined value inclusive (i.e., when the decision step S401 results in "NO"), this indicates that the lock pin 15 is in the unlocked state. Accordingly, the pin-lock flag is set to "0" in a step S403, whereon the processing routine shown in FIG. 4 is terminated [Return].

After the decision as to the locked state through the processing routine shown in FIG. 4, the processing procedure shown in FIG. 2 is executed to make decision as to whether or not the pin unlocking control should be performed in association with the advancing control, and the pin unlocking control is carried out when the pin is in the locked state while the ordinary valve timing advancing control is straightforwardly effected if the pin is in the unlocked state. Of course, when the pin is in the locked state, the valve timing advancing control is performed after effectuating the pin unlocking control.

As is apparent from the above, decision as to the locked/unlocked state of the lock pin can be performed through simple procedure on the basis of only the detected advance quantity (detected phase angle Vd). On the other hand, in the case where the valve timing advancing control is performed from the most retard position after the decision as to the locked state of the lock pin, the lock pin 15 can be prevented from falling into jammed state by carrying out the pin unlocking control. Thus, degradation of the drivability, fuel cost performance and the exhaust gas quality of the engine which may otherwise be brought about by the jam of the lock pin 15 can positively be prevented.

Embodiment 4

In the valve timing control apparatus according to the third embodiment of the invention, the locked state is determined on the basis of only the detected phase angle Vd. In the valve timing control apparatus according to a fourth embodiment of the invention, the control time required for reaching the target phase angle Vt is employed for making decision as to the locked state of the lock pin.

The mechanical structure of the valve timing control apparatus according to the fourth embodiment of the invention is essentially same as that of the conventional apparatus described hereinbefore in conjunction with FIGS. 8 to 13. The apparatus according to the instant embodiment differs from the conventional one only in several processings performed by the ECU 1117. Accordingly, the following description will be directed to the processings which differ from those of the conventional apparatus. With regard to the other respects, repeated description will be omitted. Additionally, the processing procedure shown in FIG. 2 is executed without any modification. Accordingly, repeated description thereof will be unnecessary as well.

Figure 5:
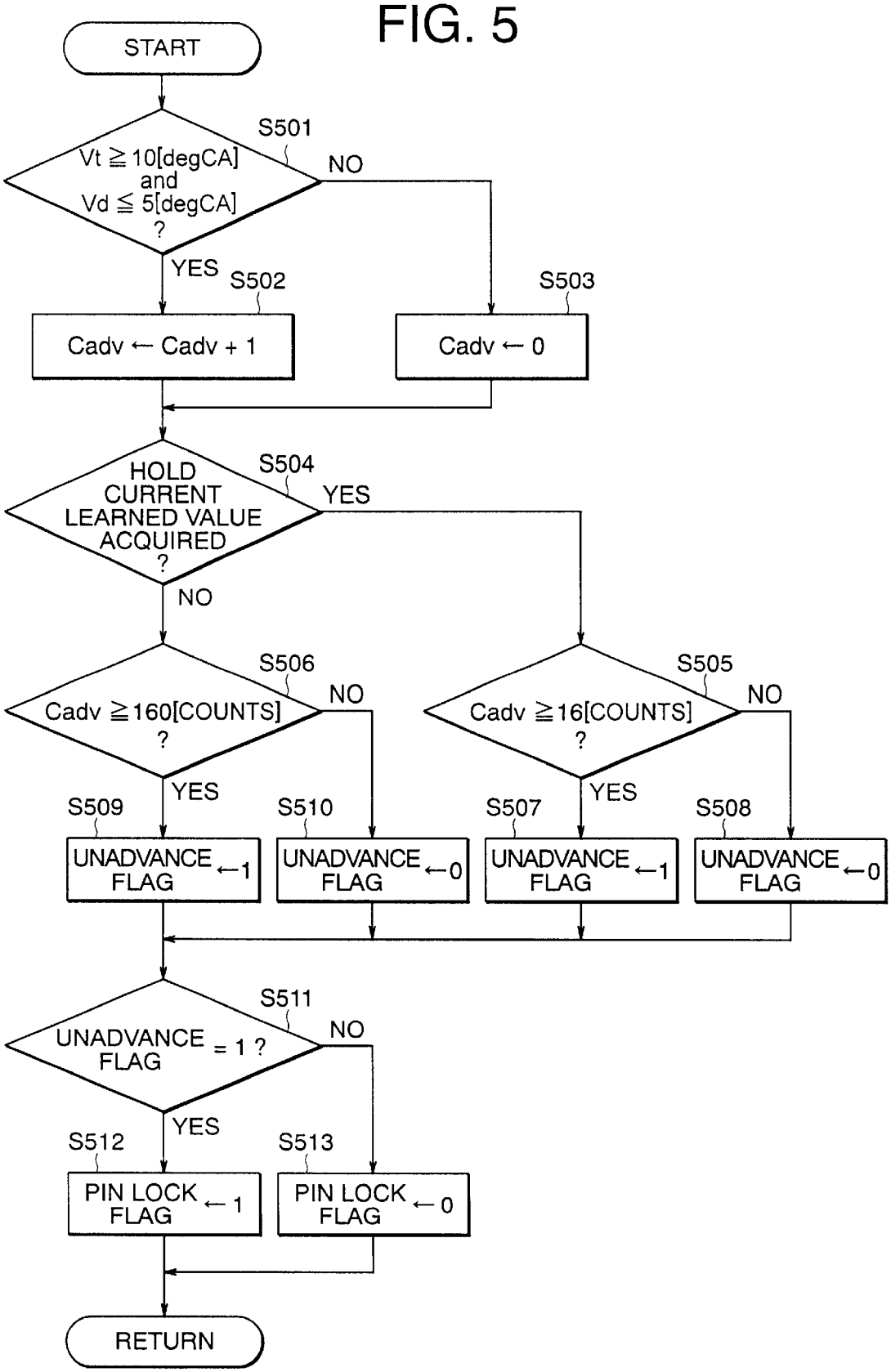
FIG. 5 is a flow chart for illustrating a processing routine executed by the ECU in the valve timing control apparatus according to a fourth embodiment of the present invention.

Referring to FIG. 5, description will be made of the locked state decision processing executed by the ECU 1117. FIG. 5 is a flow chart for illustrating a processing routine executed by the ECU of the valve timing control apparatus according to the fourth embodiment of the present invention.

Now referring to FIG. 5, decision is made in a step S501 whether or not the target phase angle Vt is greater than a predetermined value inclusive (e.g. 10 [deg. CA]) and the detected phase angle Vd is smaller than a predetermined value inclusive (e.g. 5 [deg. CA]).

When it is determined in the step S501 that the target phase angle Vt is greater than the predetermined value inclusive and that the detected phase angle Vd is smaller than the predetermined value inclusive (i.e., when the decision step S501 results in "YES"), a counter Cadv is incremented by "1" in a step S502.

On the other hand, unless the conditions for the target phase angle Vt and the detected phase angle Vd, respectively, are satisfied i.e., when the decision step S501 results in "NO"), the counter Cadv is cleared to "0" in a step S503.

In succession, it is checked in a step S504 whether or not a learned value of hold current (hereinafter referred to as the learned value) which represents the control current value of the oil control valve 1114 in the state where the target phase angle Vt substantially coincides with the detected phase angle Vd has been acquired (i.e., learned) on the basis of the target phase angle Vt.

When it is decided in the step S504 that the hold current learned value has already been acquired (i.e., when the decision step S504 results in "YES"), decision is then made as to whether or not the value of the counter Cadv is equal to or greater than a predetermined value (e.g. 16 counts) in a step S505.

When it is found in the step S504 that the hold current learned value has not been acquired (i.e., when the decision step S504 results in "NO"), decision is then made as to whether or not the value of the counter Cadv is equal to or greater than a predetermined value (e.g. 160 counts) in a step S506.

When it is determined in the step S505 that the value of the counter Cadv is greater than the predetermined value inclusive (i.e., when the decision step S505 results in "YES"), an unadvance flag is set to "1" (step S507). On the other hand, when the value of the counter Cadv is smaller than the predetermined value (i.e., when the decision step S505 results in "NO"), the unadvance flag is set to "0" (step S508).

Further, when it is determined in the step S506 that the value of the counter Cadv is greater than the predetermined value inclusive (i.e., when the decision step S506 results in "YES"), the unadvance flag is set to "1" (step S509). On the other hand, when the value of the counter Cadv is smaller than the predetermined value (i.e., when the decision step S506 results in "NO"), the unadvance flag is set to "0" (step S510).

Parenthetically, the processing routine shown in FIG. 5 is executed periodically at a predetermined time interval (e.g. every 25 ms). Accordingly, the time lapse can arithmetically be determined on the basis of the number of times the processing routine shown in FIG. 5 was executed (i.e., the counter value). For example, the counter value "16" indicates the time lapse of 0.4 sec. while "160" indicates the time lapse of 4 sec.

Subsequently, in a step S511, decision is made as to whether or not the unadvance flag is "1". When the unadvance flag is "1" (i.e., when the decision step S511 results in "YES"), it is determined that the pin 15 is in the locked state. Accordingly, the pin-lock flag is set to "1" in a step S512. On the other hand, unless the unadvance flag is "1" (i.e., when the decision step S511 results in "NO"), this indicates that the lock pin 15 is in the unlocked state. Accordingly, the pin-lock flag is set to "0" in a step S513. Thereafter, the processing routine shown in FIG. 5 is terminated [Return].

In succession to the decision as to the locked state after the predetermined time lapse through the processing routine shown in FIG. 5, the processing procedure shown in FIG. 2 is executed to make decision as to whether or not the pin unlocking control should be performed in the valve timing advancing control mode, and the pin unlocking control is carried out when the pin is in the locked state while the ordinary valve timing advancing control is effected if the pin is in the unlocked state.

In this way, when the state in which the detected phase angle Vd does not follow the target phase angle Vt notwithstanding of the command for advancing the valve timing toward the target phase angle Vt but remains retarded by a predetermined quantity or more has continued for a predetermined time period, it is then determined that the lock pin 15 is in the locked state. Accordingly, by carrying out the pin unlocking control, the drivability, fuel cost performance and the exhaust gas quality of the engine can positively be protected against degradation which may otherwise be brought about by the valve timing advancing failure due to the jam of the lock pin 15.

Embodiment 5

In the foregoing description concerning the first to fourth embodiments of the present invention, it has been presumed that the pin unlocking control of the lock pin 15 is performed immediately after the operation of the engine 1101 has been started. In the valve timing control apparatus for the engine according to a fifth embodiment of the invention, the processing procedure is so designed that the pin unlocking control is inhibited for a predetermined time period after the start of the engine operation.

The mechanical structure of the valve timing control apparatus according to the fifth embodiment of the invention is essentially same as that of the conventional apparatus described hereinbefore (FIGS. 8 to 13). The apparatus according to the instant embodiment differs from the conventional one only in several processings executed by the ECU 1117. Accordingly, the following description will be directed to the processings which differ from those of the conventional apparatus. With regard to the other respects, repeated description will be unnecessary.

Figure 6:
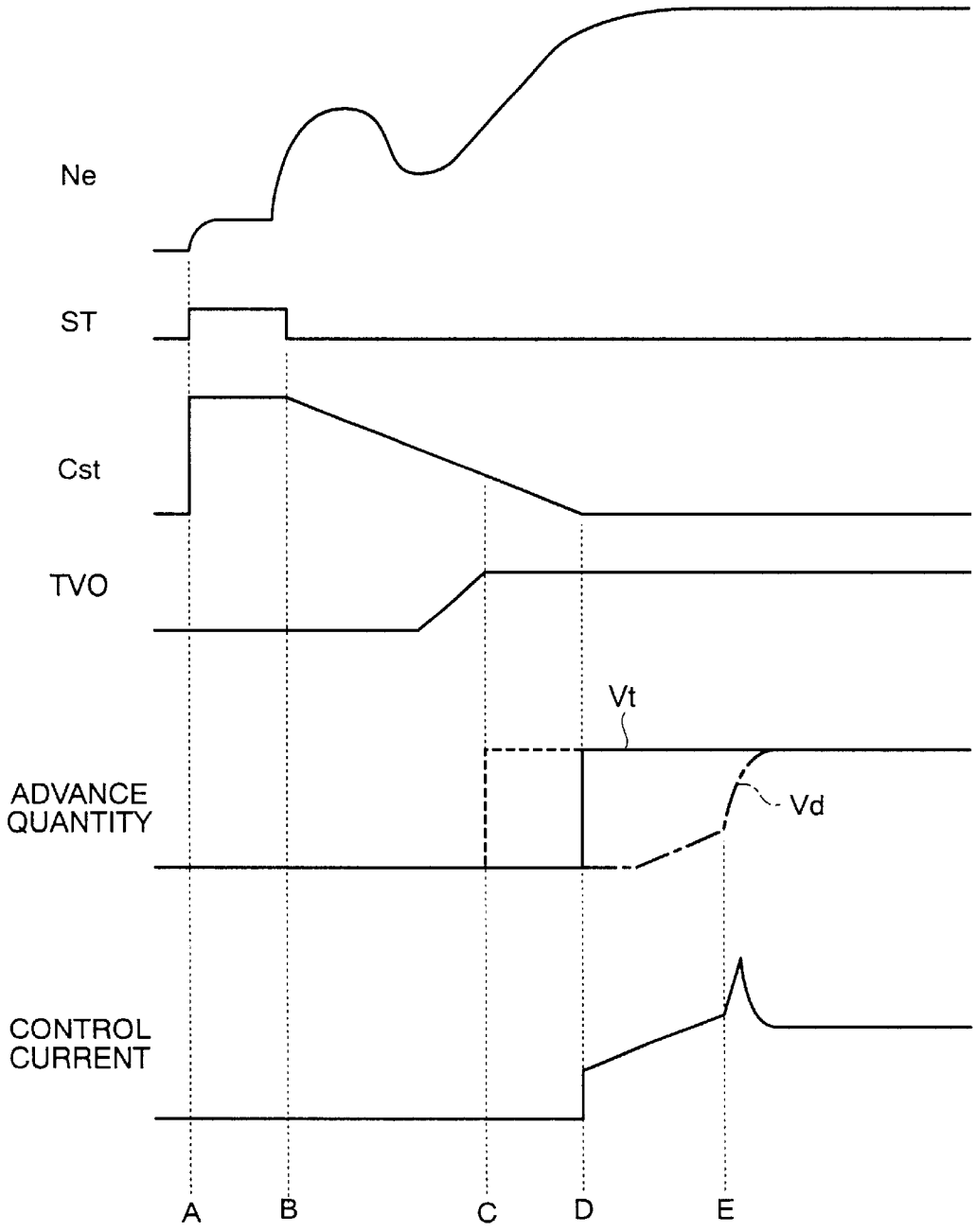
FIG. 6 is a timing chart for graphically illustrating operations carried out in the valve timing control apparatus according to a fifth embodiment of the present invention.

Referring to FIG. 6, description will be made of operation in the phase feedback control performed by the ECU 1117. FIG. 6 is a timing chart for graphically illustrating operations effectuated in the valve timing control apparatus according to the instant embodiment of the present invention.

In FIG. 6, time is taken along the abscissa with various operation timings and parameters being taken along the ordinate.

Referring to FIG. 6, at a time point A, the starter ST is rotated to put into operation the internal combustion engine 1101 (starting mode). Further, a post-start counter Cst is set to a predetermined value (e.g. 5 [sec.]).

When the rotation speed Ne of the engine increases steeply at a time point B, being followed by decreasing, it is decided that operation of the engine 1101 has been started, and the starter is released to terminate the engine starting operation or mode. At the same time, the count value of the post-start counter Cst is decreased decrementally.

When the rotation speed Ne of the engine again increases at a time point C, the target phase angle Vt (represented by a broken line curve) which is arithmetically determined on the basis of the operating state of the engine 1101 changes in the valve timing advancing direction (with the target phase angle being computed such that the advance quantity increases). However, since the post-start counter Cst is being decreased decrementally (i.e., being counted down), the target phase angle (represented by a solid line curve in FIG. 6) commanded by the ECU 1117 will remain at the most retard angular position.

When the count of the post-start counter Cst becomes zero at a time point D, this indicates that the predetermined time (e.g. 5 [sec.]) has lapsed since the start of the engine operation. In that case, the valve timing advance control is so performed that the target phase angle Vt (solid line curve section) commanded by the ECU 1117 coincides with the target phase angle Vt (broken line curve section) arithmetically determined on the basis of the operating state, to thereby advance the valve timing.

When the target phase angle Vt changes in the valve timing advancing direction, control is then so performed that the detected phase angle Vd (single-dotted broken curve) follows the target phase angle Vt (solid line curve). However, since the engine operation has just been started, it is regarded that the lock pin 15 is in the locked state, and the pin unlocking control is performed. To this end, the control current fed to the oil control valve 1114 is increased only progressively or gradually to thereby release the lock pin 15 from the retaining hole.

When the detected phase angle Vd (single-dotted line curve) has reached or exceeded the predetermined value (e.g. 5 [deg. CA]) at a time point E, it is then decided that the lock pin 15 has been released. Thereafter, the phase feedback control is carried out on the basis of deviation or error between the target phase angle Vt (solid line curve section) and the detected phase angle Vd (single-dotted line curve) so that the detected phase angle Vd (single-dotted line curve) follows (i.e., coincide with) the target phase angle Vt (solid line curve).

At the time point immediately after the internal combustion engine operation has been started, the cam phase actuator is not filled with the hydraulic medium or oil. Consequently, foreign noise may occasionally be produced upon releasing of the lock pin 15. Generation of the foreign noise indicates that the case 3 of the cam phase actuator 1113 and the rotor 6 strongly impact against each other, which may incur the possibility that the screw(s) clamping the cam phase actuator in an integral structure is loosened, as a result of which the internal combustion engine may unwantedly be injured, to a great disadvantage.

Such being the circumstances, according to the teaching of the present invention incarnated in the fifth embodiment thereof, the target phase angle Vt is not validated for advancing the valve timing in the advance direction for a predetermined time succeeding to the start of the engine operation during which the cam phase actuator is not filled with the oil serving as the hydraulic medium for actuating the cam phase actuator.

Incidentally, a curve TVO represents the timing of change in the opening degree of the throttle valve changes.

Embodiment 6

In the foregoing description concerning the fifth embodiment of the present invention, it has been presumed that the processing procedure is so designed that the pin unlocking control is not performed during the predetermined time after the start of the engine operation. In the valve timing control apparatus for the engine according to a sixth embodiment of the invention, the processing procedure is so designed that the pin unlocking control is inhibited for a time period during which the target phase angle Vt arithmetically determined on the basis of the operation state of the engine 1101 remains to reach a predetermined value.

The mechanical structure of the valve timing control apparatus according to the sixth embodiment of the invention is essentially same as that of the conventional apparatus described hereinbefore (FIGS. 8 to 13). The apparatus according to the instant embodiment differs from the conventional one in several processings executed by the ECU 1117. Accordingly, the following description will be directed to the processings which differ from those of the conventional apparatus. With regard to the other respects, repeated description will be unnecessary.

Figure 7:
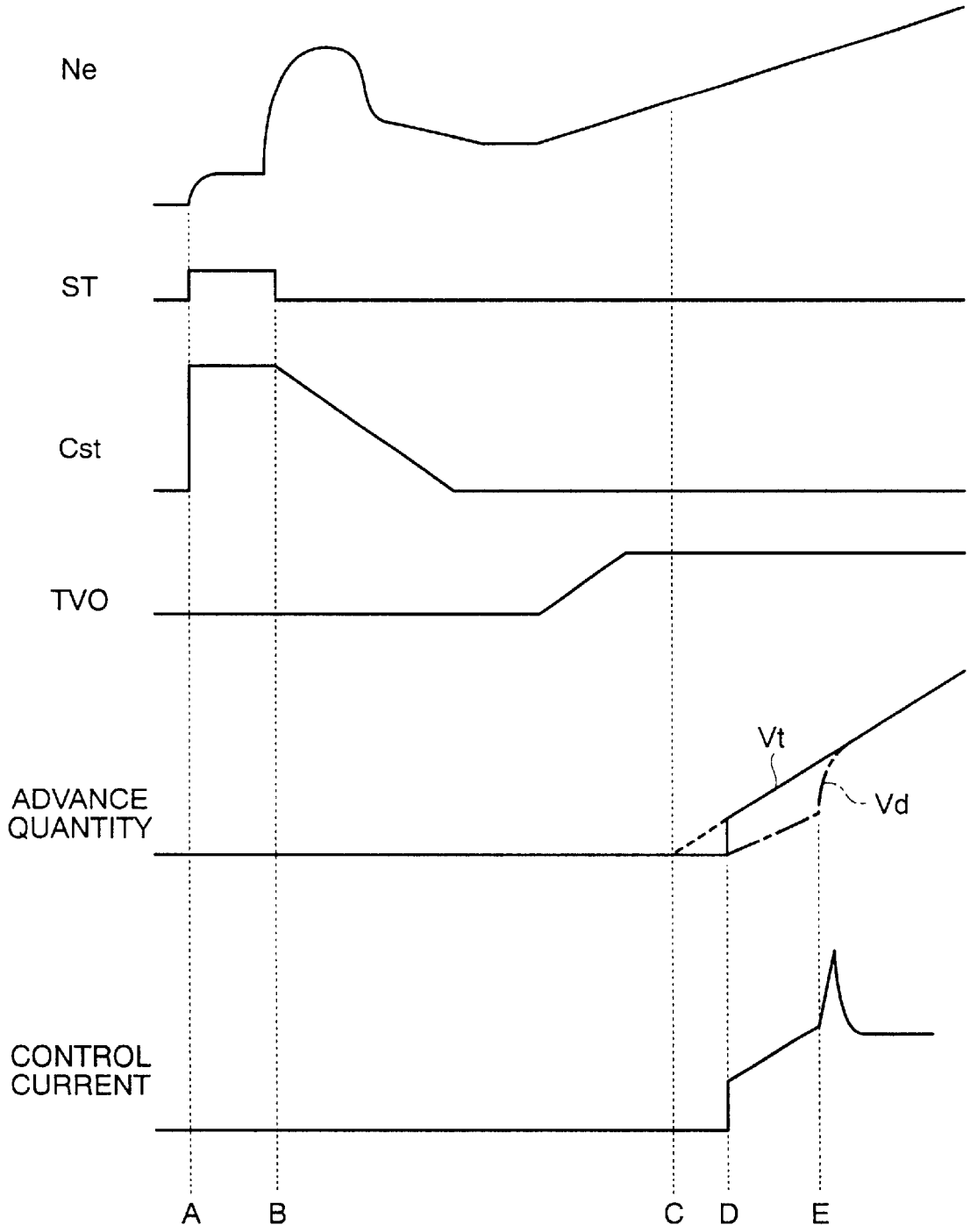
FIG. 7 is a timing chart for graphically illustrating operations carried out in the valve timing control apparatus according to a sixth embodiment of the present invention.
Figure 8:
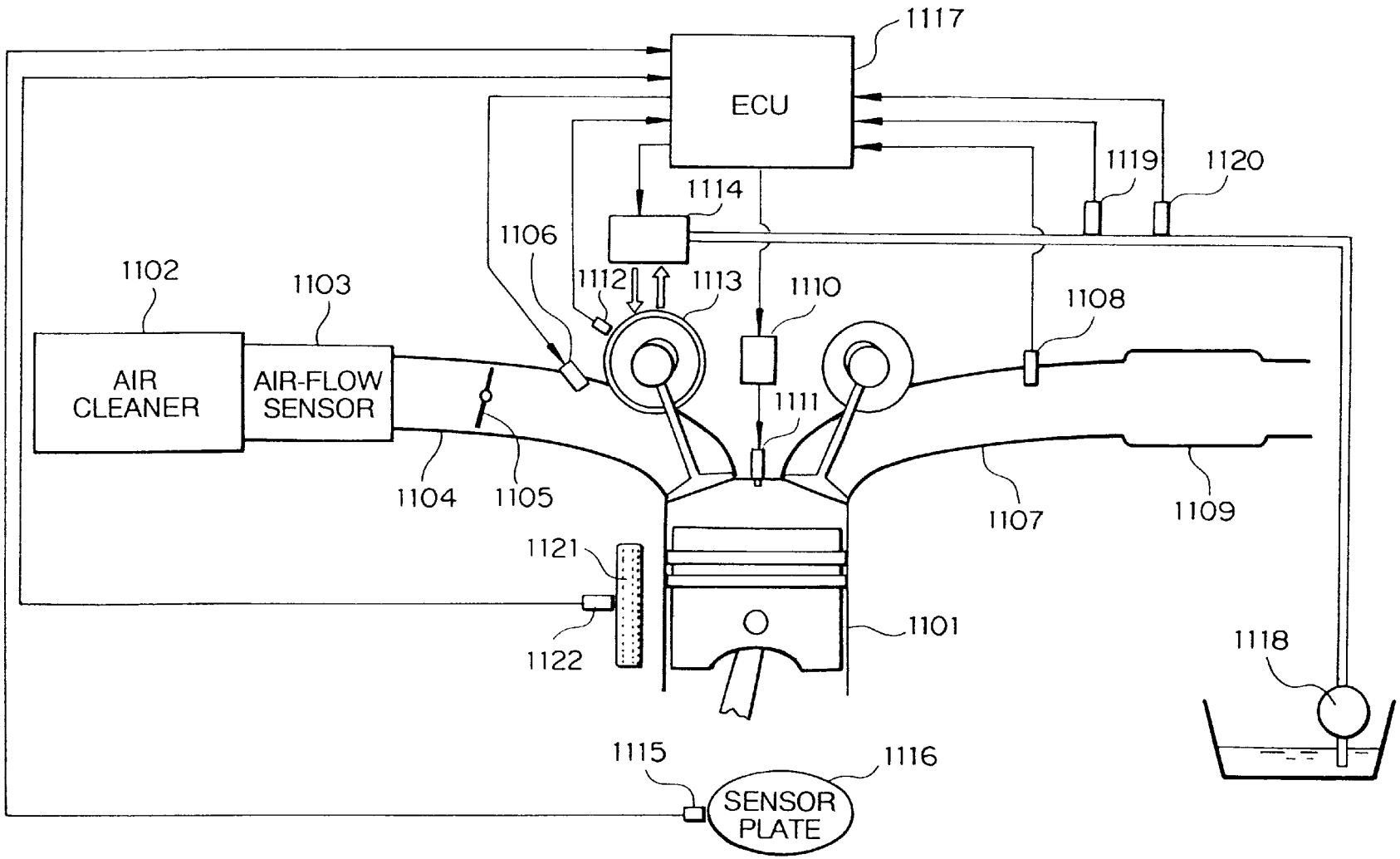
FIG. 8 is a view showing generally and schematically a structure of an internal combustion engine equipped with a conventional valve control apparatus to which the present invention can find application.
Figure 9:
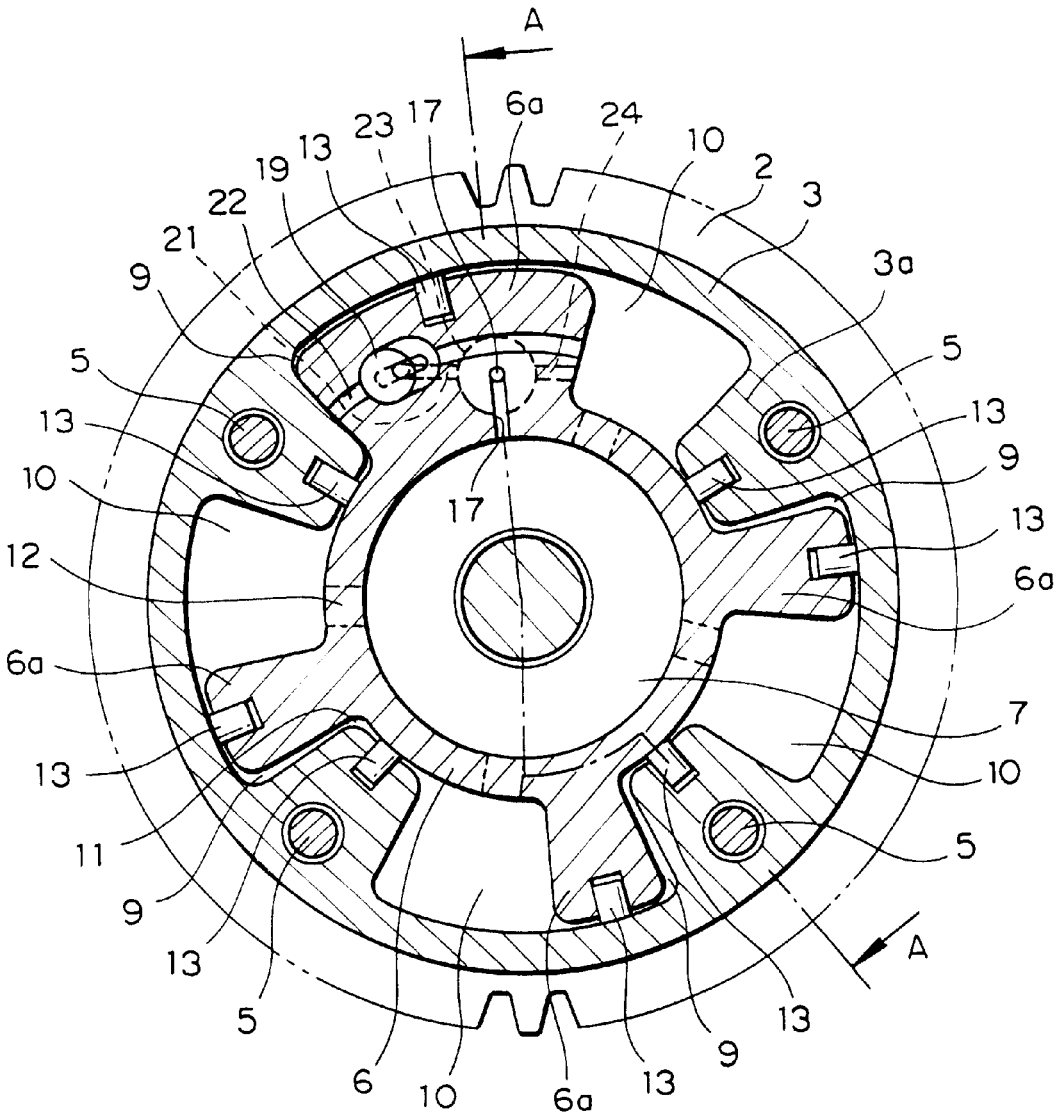
FIG. 9 is a cross sectional view showing an internal structure of a conventional vane-type valve timing control apparatus to which the present invention can be applied.
Figure 10:
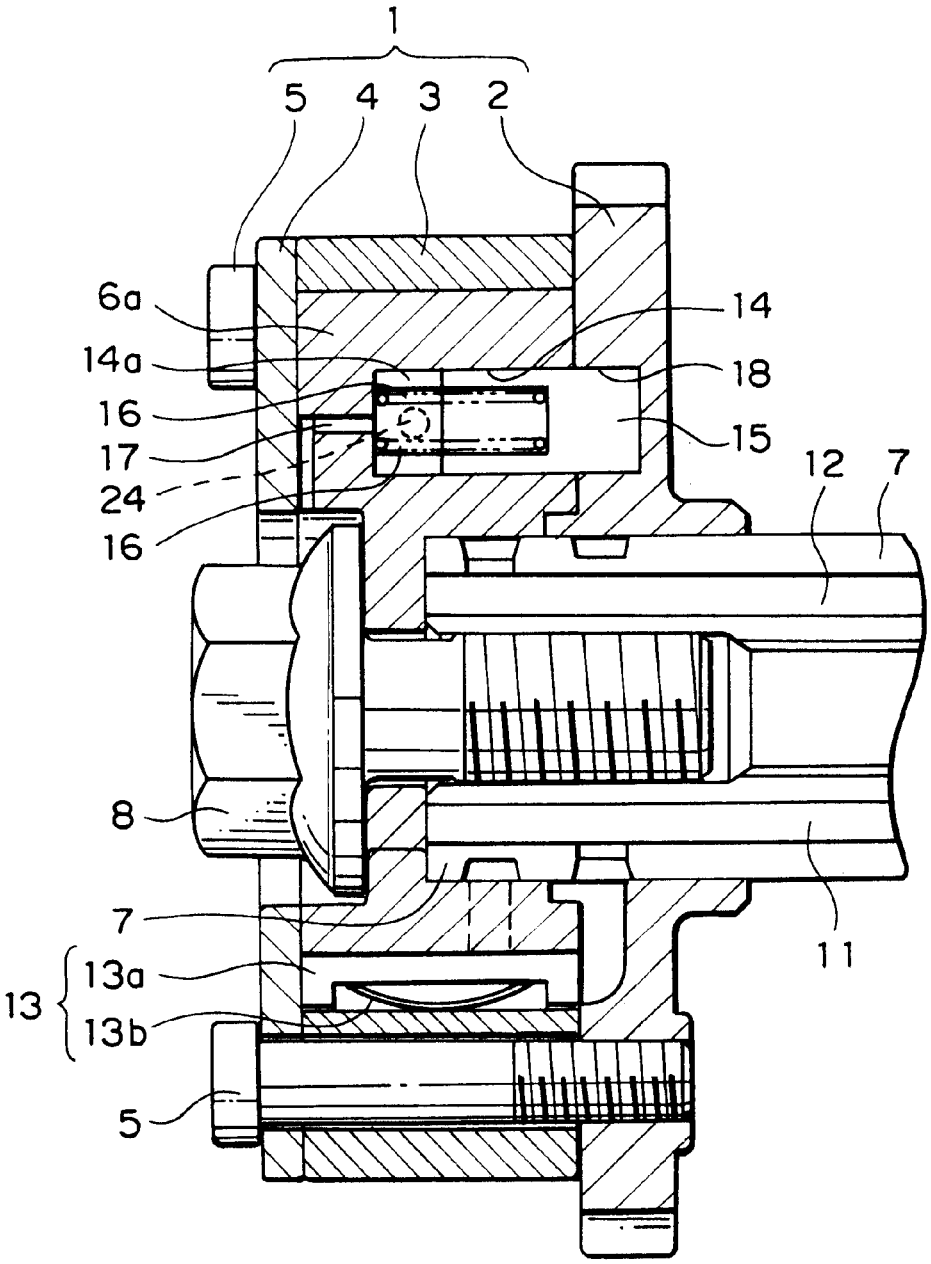
FIG. 10 is a vertical sectional view of the same taken along a line A—A shown in FIG. 9.
Figure 11:
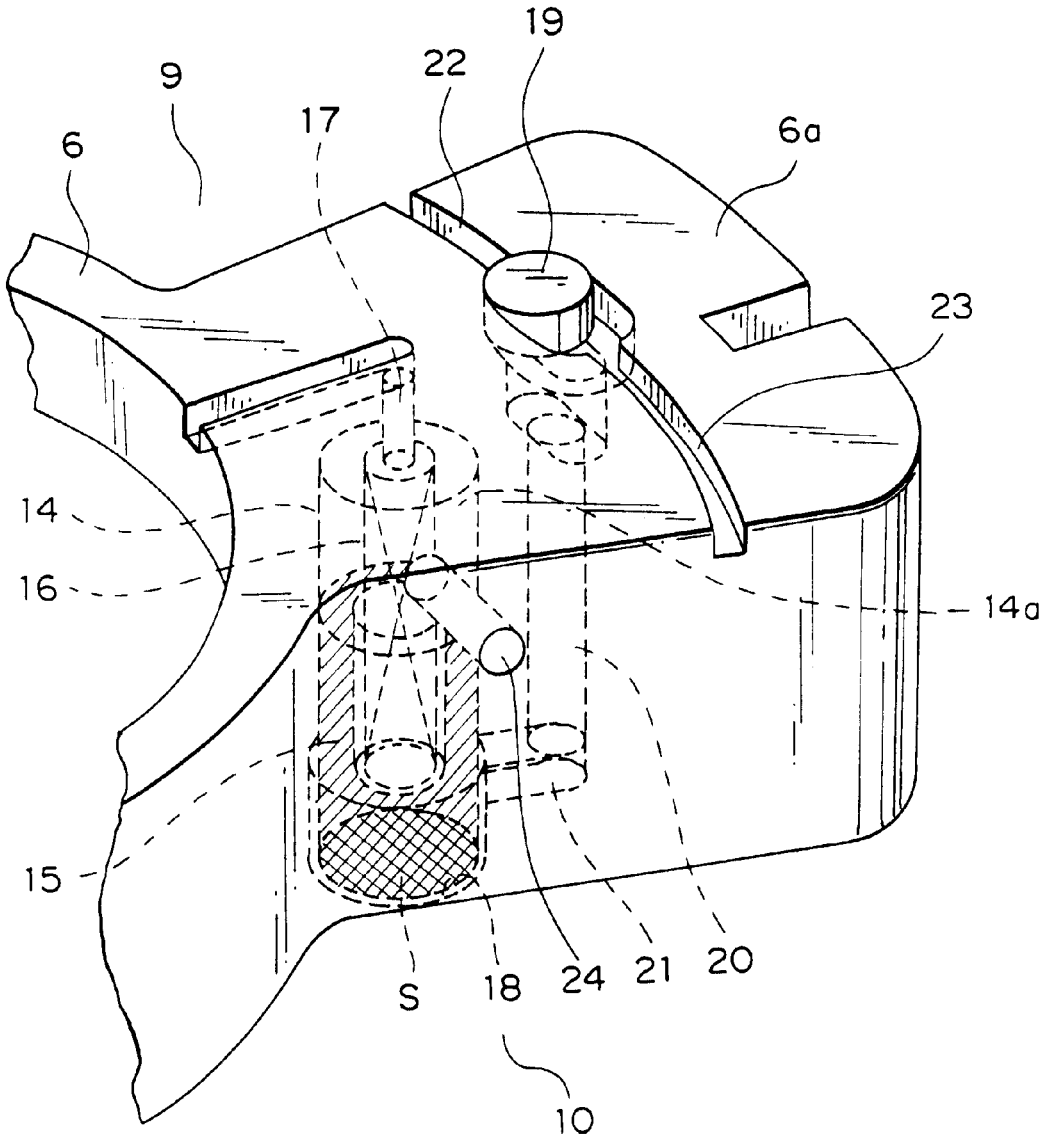
FIG. 11 is an enlarged perspective view showing a major portion of a lock/unlock mechanism of the conventional vane-type valve timing control apparatus to which the present invention can be applied.
Figure 12:
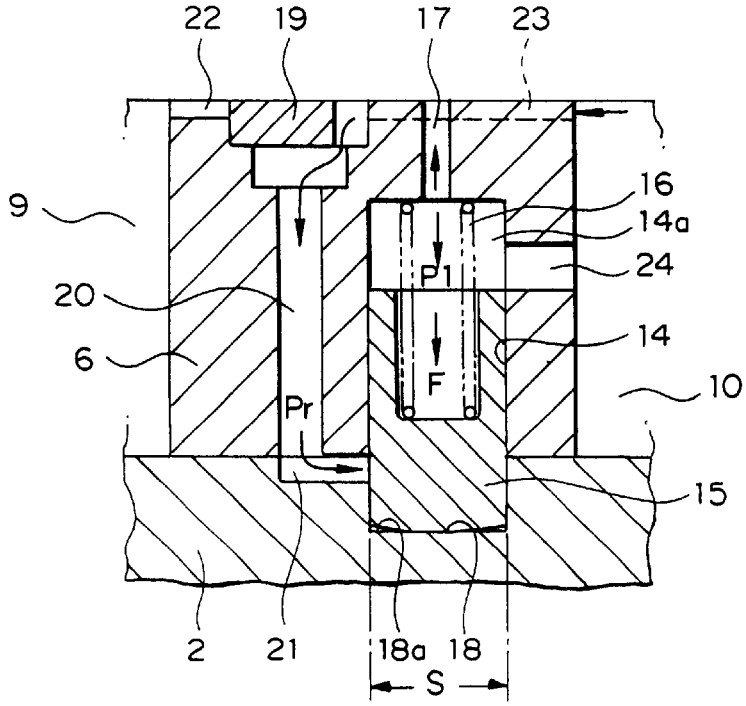
FIG. 12 is a vertical sectional view showing the lock/unlock mechanism.
Figure 13:
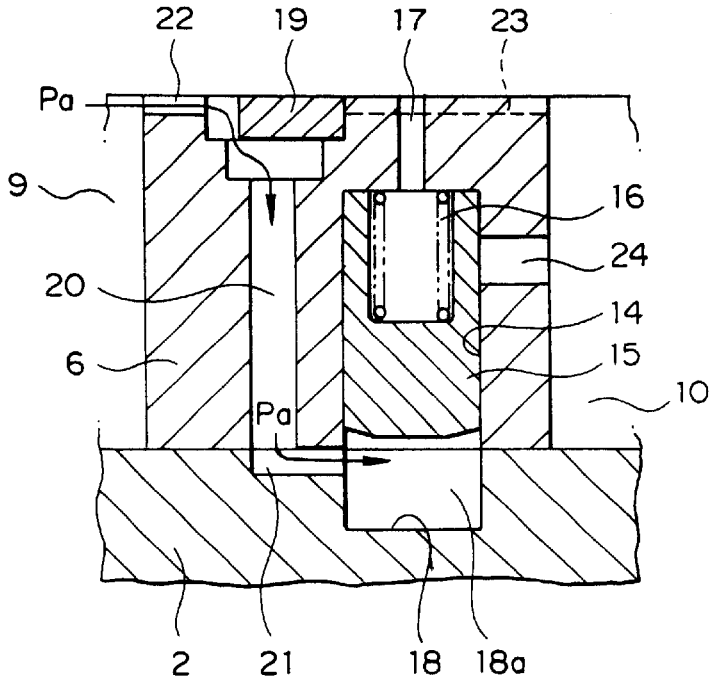
FIG. 13 is a vertical sectional view showing the same.

Referring to FIG. 7, description will be directed to operations involved in the phase feedback control performed by the ECU 1117. FIG. 7 is a timing chart for graphically illustrating operations effectuated in the valve timing control apparatus according to the instant embodiment of the present invention.

In FIG. 7, time is taken along the abscissa with various operation timings and parameters being taken along the ordinate.

Referring to FIG. 7, at a time point A, the starter ST is rotated to put into operation the internal combustion engine 1101 (starting mode). Further, a post-start counter Cst is set to a predetermined value (e.g. 5 [sec.]).

When the rotation speed Ne of the engine increases steeply at a time point B, being followed by decreasing, as can be seen in FIG. 7 at Ne, it is decided that operation of the engine 1101 has been started, and the starter is released to thereby terminate the engine starting operation or mode. At the same time, the count value of the post-start counter Cst is decreased decrementally.

When the rotation speed Ne again increases during a period from a time point C to a time point D, the target phase angle Vt (represented by a broken line curve section) which is arithmetically determined on the basis of the operating state of the engine 1101 changes in the valve timing advancing direction (with the target phase angle being computed such that the advance quantity increases). However, since the target phase angle Vt is smaller than a predetermined value inclusive (e.g. 5 [deg. CA]), the target phase angle Vt (represented by a solid line curve section in FIG. 7) commanded by the ECU 1117 remains zero, indicating the most retard angular position.

When the target phase angle Vt (broken line curve section) arithmetically determined on the basis of the operating state of the engine 1101 exceeds a predetermined value (e.g. 5 [deg. CA]) at a time point D, the target phase angle Vt (solid line curve section) which is commanded from the ECU 1117 changes in the valve timing advancing direction, whereby the detected phase angle Vd (single-dotted broken curve section) is caused to follow the target phase angle Vt (solid line curve section). However, since the engine 1101 has just been started, it can be regarded that the lock pin 15 is in the locked state, and the pin unlocking control is performed. To this end, the-control current fed to the oil control valve 1114 is increased only gradually to thereby release the lock pin 15 from the retaining hole.

When the detected phase angle Vd (single-dotted line curve) has reached or exceeded the predetermined value (e.g. 5 [deg. CA]) at a time point E, it is then decided that the lock pin 15 has been released. Thereafter, the phase feedback control is carried out on the basis of deviation or error between the target phase angle Vt (solid line curve section) and the detected phase angle Vd (single-dotted line curve) so that the detected phase angle Vd (single-dotted line curve) follows the target phase angle Vt (solid line curve).

In the valve timing advancing period immediately following the start of engine operation during which decision as to the pin locked/unlocked state can not be made, execution of the phase feedback control will result in divergence of the control quantity because of the locked state of the lock pin 15, making it impossible or very difficult to cause the detected phase angle Vd to follow the target phase angle Vt even after the lock pin 15 has been released, incurring thus degradation of the drivability, fuel cost performance and the exhaust gas quality of the engine.

For the reasons mentioned above, it is proposed according to the teaching of the invention incarnated in the sixth embodiment that the valve timing advancing control is inhibited by commanding the most retard angular position as the target phase angle Vt until the target phase angle Vt arithmetically determined on the basis of the operating state of the engine has reached or exceeded the predetermined value, and the phase feedback control is invalidated during the valve timing advancing period in which no decision can be made as to the pin locked/unlocked state. In this way, divergence of the control quantity which may otherwise be brought about by executing the phase feedback control notwithstanding that the lock pin 15 is in the locked state can positively be prevented, whereby the drivability, fuel cost performance and the exhaust gas quality of the engine can positively be protected against degradation.

Effects of the Invention

As is apparent from the foregoing, the present invention has provided the valve timing control apparatus for an internal combustion engine, which apparatus includes the cam phase actuator which is comprised of the first rotor rotatable in synchronism with the crank shaft of the engine, the second rotor fixed on the cam shaft for opening and closing the intake valve or the exhaust valve of the engine and the lock mechanism for locking the second rotor to the first rotor at the first relative angle in the locked state of the lock mechanism, the oil pump for generating the hydraulic pressure for the engine, the arithmetic means for arithmetically determining the current value for releasing the locked state at the first relative angle to thereby shift the first relative angle to the second relative angle, and the hydraulic pressure regulating means for supplying the hydraulic pressure for regulating the cam phase of the second rotor. The arithmetic means mentioned above is so designed as to determine discriminatively the locked state and the unlocked state of the lock mechanism to thereby allow the second rotor to be released from the state locked to the first rotor when the lock mechanism is determined as being in the locked state.

By virtue of the arrangement of the valve timing control apparatus described above, the unlocking control is effectuated only when the advancing control is to be performed in response to the decision that the lock pin or lock mechanism is in the locked state. Thus, the frequency of occurrence of delay involved in the valve timing advancing operation due to the unlocking control can be reduced. Further, the valve timing advancing control failure due to jam of the lock pin can be suppressed. Thus, the drivability and the fuel cost performance of the engine as well as deterioration of the exhaust gas quality can positively be protected against degradation with high reliability.

In the valve timing control apparatus described above, the arithmetic means can be so designed as to make decision as to whether the lock mechanism is in the locked state or in the unlocked state on the basis of a first parameter indicating operation state of the engine or alternatively a second parameter indicating operating status of the valve timing control apparatus.

With the arrangement described above, the locked state of the locking mechanism can be decided on the basis of the operation state of the engine or the operating status of the valve timing control apparatus when the pin unlocking control is to be performed upon valve timing advancing control. Thus, the valve timing advancing control can be effectuated smoothly without incurring jam of the lock pin, whereby degradation of the drivability and the fuel cost performance of the engine as well as deterioration of the exhaust gas quality can positively be prevented.

Further, the arithmetic means can be so designed as to make decision whether the lock mechanism is in the locked state or in the unlocked state on the basis of the engine rotation speed serving as the first parameter.

With the arrangement described above, the locked state is decided on the basis of the engine rotation speed indicating the engine operation state to thereby validate the unlocking control upon valve timing advancing control. Thus, the valve timing advancing control can be performed smoothly without being accompanied with jamming of the lock pin, whereby degradation of the drivability and the fuel cost performance of the engine as well as deterioration of the exhaust gas quality can be prevented with high reliability.

Furthermore, the arithmetic means can be so designed as to make decision whether the lock mechanism is in the locked state or in the unlocked state on the basis of an engine cooling water temperature serving as the first parameter.

With the arrangement described above, the locked state is decided on the basis of the temperature of the engine cooling water to validate the unlocking control upon valve timing advancing control. Thus, the valve timing advancing control can be performed smoothly without being accompanied with jamming of the lock pin, whereby degradation of the drivability and the fuel cost performance of the engine as well as deterioration of the exhaust gas quality can be suppressed with high reliability.

Furthermore, the arithmetic means can be so designed as to make decision whether the lock mechanism is in the locked state or in the unlocked state on the basis of the hydraulic pressure of the internal combustion engine serving as the first parameter.

With the arrangement described above, decision as to the locked state can be performed more positively because the decision is based on the hydraulic pressure. Thus, the valve timing advancing control can be performed smoothly without being accompanied with jamming of the lock pin, whereby degradation of the drivability and the fuel cost performance of the engine as well as deterioration of the exhaust gas quality can be prevented with high reliability.

Further, the arithmetic means can be so designed as to determine that the lock mechanism is in the locked state when a detected value of the second relative angle serving as the second parameter lies within a predetermined range covering a most retard position.

This arrangement also allows the decision as to the locked state to be performed with high reliability and accuracy. Thus, the valve timing advancing control can be performed smoothly without being accompanied with jamming of the lock pin, whereby degradation of the drivability and the fuel cost performance of the engine as well as deterioration of the exhaust gas quality can be prevented with high reliability.

Moreover, the arithmetic means can be so designed as to determine that the lock mechanism is in the unlocked state when a detected value of the second relative angle serving as the second parameter is greater than a predetermined value inclusive.

With this arrangement, the control can be much simplified because the locked state is decided only on the basis of the detected advance quantity. Further, upon advancing control from the most retard position succeeding to the decision of the locked state, the pin unlocking control can be performed without being accompanied with jamming of the lock pin. Thus, degradation of the drivability and the fuel cost performance of the engine as well as deterioration of the exhaust gas quality due to failure of the valve timing advancing control can positively be prevented.

Furthermore, the arithmetic means can be so designed as to determine that the lock mechanism is in the locked state when a state in which a target value of the second relative angle arithmetically determined on the basis of the first parameter is not smaller than a predetermined value and in which a detected value of the second parameter is not greater than a predetermined value has continued for a predetermined time period.

With the arrangement described above, it is decided that the lock pin is in the locked state in the case where the state in which the detected phase angle does not follow the target phase angle but is retarded at least a predetermined time duration notwithstanding the valve timing advance command is issued, whereon the pin unlocking control is effectuated. Thus, degradation of the drivability and the fuel cost performance of the engine as well as deterioration of the exhaust gas quality due to the jam of the lock pin can be avoided with high reliability.

In the valve timing control apparatus described just above, the arithmetic means can include a control quantity learning means for learning a control quantity for the hydraulic pressure regulating means at which the detected value reaches the target value. In that case, the predetermined time period mentioned above can be determined on the basis of learning status of the control quantity learning means.

By virtue of the above arrangement, the predetermined time period can be set accurately, which in turn can ensure reliable and accurate decision as to the locked state of the lock pin, whereby degradation of the drivability and the fuel cost performance of the engine as well as deterioration of the exhaust gas quality due to the jam of the lock pin can be avoided satisfactorily.

Furthermore, the arithmetic means can be so designed as to inhibit releasing of the locked state in dependence on a target value of the second relative angle arithmetically determined on the basis of the first parameter indicating the operation state of the engine or alternatively in dependence on the first parameter.

Owing to the arrangement mentioned above, generation of foreign or abnormal noise can effectively be prevented.

In the valve timing control apparatus described just above, the arithmetic means can be so designed as to inhibit releasing of the locked state during a period which corresponds to a time lapse from a time point at which operation of the internal combustion engine is started as indicated by the first parameter to a time point at which the time lapse has reached a predetermined value.

With the above-mentioned arrangement, the lock pin is prevented from being released during the predetermined period after the start of the engine operation without issuance of the command for advancing the valve timing toward the target phase angle. Thus, generation of abnormal or foreign noise can be suppressed with high reliability.

In the valve timing control apparatus described above, the arithmetic means can be so designed as to inhibit releasing of the locked state during a period in which the target value is not greater than a predetermined value.

With the arrangement described above, the advancing control is not carried out until the target phase angle arithmetically determined on the basis of the operation state of the engine becomes greater than the predetermined value inclusive with the command value for the target phase angle being set to the most retard position while inhibiting the release of the lock pin to thereby inhibit the phase feedback control in the valve timing advancing region in which the decision as to releasing of the locked state can not be effectuated. Thus, degradation of the drivability and the fuel cost performance of the engine as well as deterioration of the exhaust gas quality can be prevented satisfactorily.

Furthermore, the arithmetic means can be so designed as to inhibit the phase feedback control for shifting the first relative angle to the second relative angle when the locked state is determined.

With the arrangement described above, the advancing control is not carried out until the target phase angle arithmetically determined on the basis of the operation state of the engine becomes greater than the predetermined value inclusive with the command value for the target phase angle being set to the most retard position to thereby inhibit the phase feedback control in the valve timing advancing region in which decision as to unlocking can not be effectuated. Thus, degradation of the drivability and the fuel cost performance of the engine as well as deterioration of the exhaust gas quality can be suppressed satisfactorily.

Many modifications and variations of the present invention are possible in the light of the above techniques. It is therefore to be understood that within the scope of the appended claims, the invention may be practiced otherwise than as specifically described.

What is claimed is:

1. A valve timing control apparatus for an internal combustion engine, comprising:

a cam phase actuator including a first rotor rotatable in synchronism with a crank shaft of an internal combustion engine, a second rotor fixed on a cam shaft for opening and closing an intake valve or alternatively an exhaust valve of said internal combustion engine, and a lock mechanism for locking said second rotor to said first rotor at a first relative angle in a locked state of said lock mechanism;

an oil pump for generating a hydraulic pressure for said internal combustion engine;

arithmetic means for arithmetically determining a current value for releasing said locked state at said first relative angle to thereby shift said first relative angle to a second relative angle; and hydraulic pressure regulating means for supplying a hydraulic pressure for regulating a cam phase of said second rotor, wherein said arithmetic means is so designed as to determine discriminatively said locked state and an unlocked state of said lock mechanism to thereby allow said second rotor to be released from the state locked to said first rotor when said lock mechanism is determined as being in said locked state, wherein said arithmetic means is so designed as to make decision as to whether said lock mechanism is in said locked state or in said unlocked state on the basis of a first parameter indicating operation state of said internal combustion engine or alternatively a second parameter indicating operating state of said valve timing control apparatus, wherein said arithmetic means is so designed as to make decision as to whether said lock mechanism is in said locked state or in said unlocked state on the basis of rotation speed of said internal combustion engine serving as said first parameter, and wherein said arithmetic means is so designed as to make decision as to whether said lock mechanism is in said locked state or in said unlocked state on the basis of a cooling water temperature of said internal combustion engine serving as said first parameter.

2. A valve timing control apparatus for an internal combustion engine according to claim 1, wherein said arithmetic means is so designed as to make decision as to whether said lock mechanism is in said locked state or in said unlocked state on the basis of hydraulic pressure of said internal combustion engine serving as said first parameter.

3. A valve timing control apparatus for an internal combustion engine according to claim 1, wherein said arithmetic means is so designed as to determine that said lock mechanism is in said locked state when a detected value of the second relative angle serving as said second parameter lies within a predetermined range covering a most retard position.

4. A valve timing control apparatus for an internal combustion engine according to claim 1, wherein said arithmetic means is so designed as to determine that said lock mechanism is in said unlocked state when a detected value of said second relative angle serving as said second parameter is greater than a predetermined value inclusive.

5. A valve timing control apparatus for an internal combustion engine according to claim 1, wherein said arithmetic means is so designed as to determine that said lock mechanism is in said locked state, when a state in which a target value of said second relative angle arithmetically determined on the basis of said first parameter is not smaller than a predetermined value and in which a detected value of said second parameter is not greater than a predetermined value has continued for a predetermined time period.

6. A valve timing control apparatus for an internal combustion engine according to claim 5, said arithmetic means including control quantity learning means for learning a control quantity for said hydraulic pressure regulating means at which said detected value reaches said target value, wherein said predetermined time period is determined on the basis of learning status of said control quantity learning means.

7. A valve timing control apparatus for an internal combustion engine according to claim 1, wherein said arithmetic means is so designed as to inhibit releasing of said locked state in dependence on a target value of said second relative angle arithmetically determined on the basis of the first parameter indicating the operation state of said internal combustion engine or alternatively in dependence on said first parameter.

8. A valve timing control apparatus for an internal combustion engine according to claim 7, wherein said arithmetic means is so designed as to inhibit releasing of said locked state during a period which corresponds to a time lapse from a time point at which operation of said internal combustion engine is started as indicated by said first parameter to a time point at which said time lapse has reached a predetermined value.

9. A valve timing control apparatus for an internal combustion engine according to claim 7, wherein said arithmetic means is so designed as to inhibit releasing of said locked state during a period in which said target value is not greater than a predetermined value.

10. A valve timing control apparatus for an internal combustion engine according to claim 1, wherein said arithmetic means is so designed as to inhibit a phase feedback control for shifting said first relative angle to said second relative angle when said locked state is determined.

* * * * *